US005397117A

United States Patent [19]

Mertens

[11] Patent Number: 5,397,117

[45] Date of Patent: Mar. 14, 1995

[54] SHEET DISPENSER

[75] Inventor: Timothy A. Mertens, Cottage Grove, Minn.

[73] Assignee: Minnesota Mining and Manufacturing Company, St. Paul, Minn.

[21] Appl. No.: 131,910

[22] Filed: Oct. 5, 1993

[51] Int. Cl.[6] ..... B65H 1/00

[52] U.S. Cl. ..... 221/34; 221/33; 221/45; 221/70

[58] Field of Search ..... 271/34, 33, 45, 46, 271/70

[56] References Cited

U.S. PATENT DOCUMENTS

| | | | |
|---|---|---|---|
| 2,417,497 | 3/1947 | Hulslander | 221/70 |
| 3,288,327 | 11/1966 | Cahlik | 221/70 |
| 3,691,140 | 9/1972 | Silver | 260/78.5 |
| 3,857,731 | 12/1974 | Merrill, Jr. et al. | 117/122 |
| 4,166,152 | 8/1979 | Baker et al. | 428/522 |
| 4,416,392 | 11/1983 | Smith | 221/45 |
| 4,653,666 | 3/1987 | Mertens | 221/45 |
| 4,768,810 | 9/1988 | Mertens | 282/12 |
| 4,786,696 | 11/1988 | Bohnel | 426/88 |
| 4,884,719 | 12/1989 | Levine et al. | 221/70 |
| 4,895,746 | 1/1990 | Mertens | 428/40 |
| 4,907,825 | 3/1990 | Miles et al. | 281/51 |
| 5,050,909 | 9/1991 | Mertens et al. | 283/81 |
| 5,067,629 | 11/1991 | Schwartz | 221/46 |
| 5,080,255 | 1/1992 | Windorski | 221/45 |
| 5,086,946 | 2/1992 | Blackwell et al. | 221/45 |
| 5,158,205 | 10/1992 | Bodziak et al. | 221/51 |
| 5,165,570 | 11/1992 | Windorski et al. | 221/46 |
| 5,167,346 | 12/1992 | Bodziak | 221/63 |

FOREIGN PATENT DOCUMENTS

0439941A1 8/1991 European Pat. Off. .

*Primary Examiner*—H. Grant Skaggs

*Attorney, Agent, or Firm*—Gary L. Griswold; Walter N. Kirn; William L. Huebsch

[57] ABSTRACT

A sheet dispenser including a coherent stack of adhesive-bearing sheets that can be unobtrusively permanently or removably adhered on a page of a book, catalog, brochure, etc. The dispenser has a supple cover layer that is a thin, tear-resistant polymeric film that has opposite retaining peripheral portions extending around the sides of the stack and attached to a backing sheet for the dispenser, and has a pressure-sensitive adhesive layer on one or two attachable peripheral portions of the cover layer by which the dispenser can be adhered to the page.

17 Claims, 5 Drawing Sheets

SHEET DISPENSER

FIELD OF THE INVENTION

The invention relates to dispensers for sheets from a coherent stack of sheets, each sheet bearing a band of pressure-sensitive adhesive, such as a repositionable pressure-sensitive adhesive, by which it can be self-adhered to a variety of surfaces. The invention is particularly related to such dispensers which have a low profiles so that they can be adhered to an inside page of a magazine, catalog, notebook, personal organizer or the like without creating an unsightly bulge.

BACKGROUND OF THE INVENTION

Minnesota Mining and Manufacturing Company or 3M (the company to which this application is assigned) has developed a rather low profile dispenser for a stack of paper sheets that is described in co-assigned U.S. Pat. No. 5,158,205 (Bodziak et al.). In FIGS. 1–6 of the Bodziak patent, a dispenser made of folded card stock forms a chamber closely containing a stack (12) of paper sheets. Centrally across the top wall (22) of that dispenser is a slot (30) through which paper sheets can be successively pulled from the stack. Each of the sheets has a narrow band of repositionable pressure-sensitive adhesive (14) coated on one surface adjacent one edge. When the uppermost sheet of the stack is pulled through the slot, flanking slits (24) at each end of the slot allow one of two opposed flap-like portions (28) of the top wall to flex as shown in FIG. 4 while the other flap-like portion places a drag on the next sheet so that the uppermost sheet will peel away from the next sheet.

The pop-up dispenser of the Bodziak patent is being used for coherent stacks of Post-it (TM) brand self-stick repositionable notes that consist of pieces of paper, each having a narrow band of repositionable pressure-sensitive adhesive coated on one surface adjacent one edge. Among a variety of other pop-up dispensers that have been described in the art for use with coherent stacks of Post-it (TM) brand self-stick repositionable notes are those disclosed in co-assigned U.S. Pat. Nos. 4,416,392 (Smith), 4,653,666 (Mertens), 5,080,255 (Windorski), 5,165,570 (Windorski et al), 5,167,346 (Bodziak et al) and 5,158,205 (Bodziak et al). FIGS. 1–13 of U.S. Pat. No. 5,165,570 illustrate dispensers having a base surface bearing a pair of foam-backed pressure-sensitive adhesive strips covered with a release liner by which the dispenser can be adhesively anchored to a substrate.

U.S. patent application Ser. No. 08/101,615 filed Aug. 3, 1993, (the content whereof is incorporated herein by reference) describes low profile sheet dispenser subassemblies and low profile sheet dispensers for coherent stacks of Post-it (TM) brand self-stick repositionable notes, for coherent stacks of Post-it (TM) brand repositionable tape flags described in co-assigned U.S. Pat. No. 4,907,825, and other coherent stacks of adhesive bearing sheets such as those described in U.S. Pat. No. 4,895,746 (Mertens) and U.S. Pat. No. 5,086,946 (Blackwell); which low profile sheet dispenser subassemblies or sheet dispensers are adapted to be adhered to a substrate such as on an inside page of a book, catalog, brochure, personal organizer or the like.

SUMMARY OF THE INVENTION

The present invention provides an improved novel structure for sheet dispensers including coherent stacks of Post-it (TM) brand self-stick repositionable notes that consist of pieces of paper, each having a narrow band of repositionable pressure-sensitive adhesive coated on one surface adjacent one edge, but which could as well be used for tape flags or other adhesive-bearing sheets of the types described above; which dispensers can be adhered to a substrate and will have low profiles like the above-discussed low-profile dispensers, permitting them to be used unobtrusively on an inside page of a book, catalog, brochure, personal organizer or the like.

Generally, the sheet dispenser according to the present invention comprises:

(a) a stack of sheets (e.g., repositionable paper notes or tape flags) disposed one on top of another with ends of the sheets being in alignment in the stack, and layers of adhesive permanently adhered to first side surfaces of backings for the sheets and releasably adhered along opposite second surfaces of the adjacent sheets in said stack. At least some of the sheets comprise release means for providing a first adhesion level along first end portions of the sheets adjacent first ends of the backings between the first and second side surfaces of the adjacent sheets in the stack, which first adhesion level provides a sufficiently low or no release force between the first side surfaces and the adjacent sheets to which the adhesive along those first side surfaces are releasable adhered to afford sliding movement between the side surfaces of the adjacent sheets along the first end portions, and attachment means for providing a second adhesion level along second end portions of the sheets adjacent second ends of the backings between the layers of adhesive and the second side surfaces of the adjacent sheets in the stack to which the layers of adhesive are releasably adhered, which second adhesion level provides a release force that is higher than the sufficiently low release force along the first end portions and firmly adhere the sheets to the adjacent sheets in the stack during sliding movement of the sheets relative to the adjacent sheets along the first end portions while affording peeling away of the sheets from the stack along the second end portions;

(b) a cover layer having inner and outer major surfaces, a central portion, two retaining peripheral portions along opposite sides of the central portion, one attachable peripheral portion along one side of the central portion between the two retaining peripheral portions or two attachable portions on opposite sides of the central portion between the two attachable portions, and a through slot extending transversely across the central portion;

(c) a coating of pressure-sensitive adhesive on the inner surface along the attachable peripheral portion of the cover layer;

(d) means for causing the inner surface along the central portion to be free of exposed adhesive;

(e) the stack of sheets being positioned along the inner surface adjacent the central portion with the first end portion of the uppermost sheet in the stack extending through the slot;

(f) a backing sheet positioned adjacent the lowermost sheet on the stack with the layer of adhesive on the lowermost sheet adhered to the backing sheet along a first end;

(g) the two retaining peripheral portions extending around the adjacent sides of the stack and being affixed along opposite sides of the backing sheet;

(h) the dispensable sheets and slot being adapted to afford dispensing of the sheet having the first end portion extending through the slot when that first end portion is manually pulled through the slot by sequential sliding movement of one of the sheets relative to the adjacent sheet along the first end portion and peeling away of the sheet from the stack along said second end portion, and positioning of the first end portion of an underlying dispensable sheet in a position extending through the slot as a result of such dispensing; and (i) the attachable peripheral portion or portions of the cover layer affording attachment of the dispenser to a substrate.

The backing sheet can be the same size as the dispensable sheets on the stack. Alternatively, the backing sheet can be longer than the dispensable sheets on the stack and have first and second backing sheet portions on opposite sides of either (1) a transverse fold parallel to its ends or (2) an adhesive strip permanently adhering together two separate sheet portions along one edge, with the first portion of the backing sheet including its first end, the two retaining peripheral portions being attached to the second portion of the backing sheet, and at least part of the first portion of the backing sheet being adapted to be pulled through the slot with the lowermost dispensable sheet in the stack during dispensing of that sheet.

The backing sheet can have a surface bearing indicia, such as an advertisement or reorder information, which indicia bearing surface is positioned so that it will be viewed after the first portion of the backing sheet is pulled through the slot when the lowermost sheet of the stack is dispensed.

The backing sheet can have a single fold or adhesive strip with the first and second backing sheet portions being of generally equal size so that only a part of the first backing sheet portion will be pulled through the slot when the lowermost sheet of the stack is dispensed. Alternatively, the second backing sheet portion can be much longer than the first backing sheet portion and can have one or more folds or adhesive joining strips defining different parts of the second backing sheet portion on opposite sides of those folds or strips with one part of the second backing sheet portion adjacent the second end of the backing sheet, and the second pair of peripheral portions being affixed to that one part of the backing sheet's second portion. Such backing sheets can be very long so that their first portions and part of their second portions will be pulled through the slot when the lowermost sheet of the stack is dispensed, thereby providing a large surface on their backing sheets that can be printed with advertising, messages, manufacturers coupons or the like. Also, the surface of the backing sheet to which the second pair of peripheral portions is affixed can bear such printing which can be read by a user when the dispenser is not adhered to a substrate.

The coating of pressure-sensitive adhesive can cover the entire inner surface of the cover layer and a layer of non-adhesive material (e.g., paper) can be adhered to the pressure-sensitive adhesive layer along the central portion of the cover layer to provide the means for causing the inner surface along the central portion to be free of exposed adhesive, leaving the pressure-sensitive adhesive layer exposed along the two retaining peripheral portions and along the attachable peripheral portion or portions.

The cover layer and the pressure-sensitive adhesive layer can be transparent, and the layer of material can be printed with indicia (e.g., advertisements, a users name, etc.) on the surface thereof adhered to the pressure-sensitive adhesive layer. This allows the indicia to be readable through the cover layer.

Means for protecting the coatings of pressure-sensitive adhesive on the inner surface along the attachable peripheral portion or portions of the cover layer can be provided by a disposable release liner or liners removably adhered to the coatings of pressure-sensitive adhesive. The release liner can be sized for a single sheet dispenser or can be an elongate strip with a plurality of the sheet dispensers along its length which is wound into a roll for convenient storage and shipment.

The protecting and retaining means can also be provided by the sheet dispenser being one of a plurality of sheet dispensers which are disposed adhered together with the layers of pressure-sensitive adhesive along the attachable peripheral portion or portions of the cover layers on at least some of the sheet dispensers releasably adhered to the outer surface of the cover layer on an underlying adjacent sheet dispenser such as (1) by the sheet dispensers being aligned in a stack, or (2) the cover layers of the sheet dispensers being provided by a substantially continuous polymeric film that is perforated between adjacent dispensers to afford separation of the dispensers, and the substantially continuous polymeric film being helically wound into a roll.

Alternatively, the means for protecting the coatings of pressure-sensitive adhesive on the inner surface along the attachable peripheral portion or portions of the cover layer can be provided by the attachable peripheral portion or portions being temporarily and releasably adhered to the outer surface of the backing sheet, which will normally be the case if repositionable pressure sensitive adhesive is used for those coatings, and which may require a coating of a suitable release material on the appropriate portions of the backing sheet if a more aggressive pressure-sensitive adhesives is used for those coatings.

The cover layer can be of strong, supple tear resistant paper or polymeric material, and can be less than 0.2 millimeter (0.008 inch) in thickness. Preferably the cover layer is from 0.02 to 0.1 millimeter (0.00075 to 0.004 inch) in thickness. A polymeric film material that is useful as the cover layer is biaxially oriented polypropylene which is especially useful at thicknesses from 0.02 to 0.05 millimeter (0.00075 to 0.002 inch). Among other useful tear-resistant polymeric films are biaxially oriented polyethylene and biaxially oriented. poly(ethyleneterephthalate). The polymeric film used for the cover layer can be reinforced by filaments or other fibers including paper. The backing layer of the sheet dispenser may be of a strong and tear-resistant material like the cover layer, but does not always need to be tear-resistant. Paper backing layers which can be easily printed may be preferable for many purposes.

Because the cover layer and the backing layer can be quite thin, the sheet dispensers can have a low profile that is only slightly thicker than its stack. The cover layer and the backing layer can be supple so that they do not need to be embossed and so that the sheet dispensers can flex somewhat without being damaged when they are adhered on the surface of a flexible sheet or similar structure. The cover layer also should have good dimensional stability to afford a durable, attractive appearance.

The uppermost sheet that initially extends through the slot can be a disposable leader which, when pulled through the slot, leaves the next (now uppermost) sheet extending through the slot.

The layer of pressure-sensitive adhesive on the attachable portion or portions by which the sheet dispenser can be adhered to a substrate can be of an aggressive adhesive to afford permanent mounting on most surfaces, or can be of repositionable pressure sensitive adhesive to permit the sheet dispenser to be moved from place to place and eventually removed and discarded after its stack has been exhausted. While some conventional pressure-sensitive adhesives are repositionable, an especially useful unconventional class is based on solid, inherently tacky, elastomeric microspheres, such as pressure-sensitive adhesives disclosed in the following co-assigned patents: U.S. Pat. Nos. 3,691,140 (Silver), 3,857,731 (Merrill et al.), 4,166,152 (Baker et al.), and 4,786,696 (Bohnel), and EP No. 439,941 (Bohnel et al.). The latter discloses a high-tack pressure-sensitive adhesive that would enhance the ability of the novel sheet dispenser to remain securely mounted on a vertical flat surface.

Different types of dispensers including stacks of different types of sheets that, for stacks of only a few sheets, can be emulated by sheet dispenser according to the present invention include those described in U.S. Pat. No. 4,.907,825 (Miles et al, see FIGS. 3–7); U.S. Pat. No. 5,050,909 (Mertens et al, see FIGS. 11–13); U.S. Pat. No. 5,158,205 (Bodziak, see FIGS. 1–8), and U.S. Patent No. 5,086,946 (Blackwell et al).

BRIEF DESCRIPTION OF THE DRAWING

The present invention will be further described with reference to the accompanying drawing wherein like parts are identified with like reference numerals in the several views and wherein.

DESCRIPTION OF THE PREFERRED EMBODIMENTS

Figure 1:
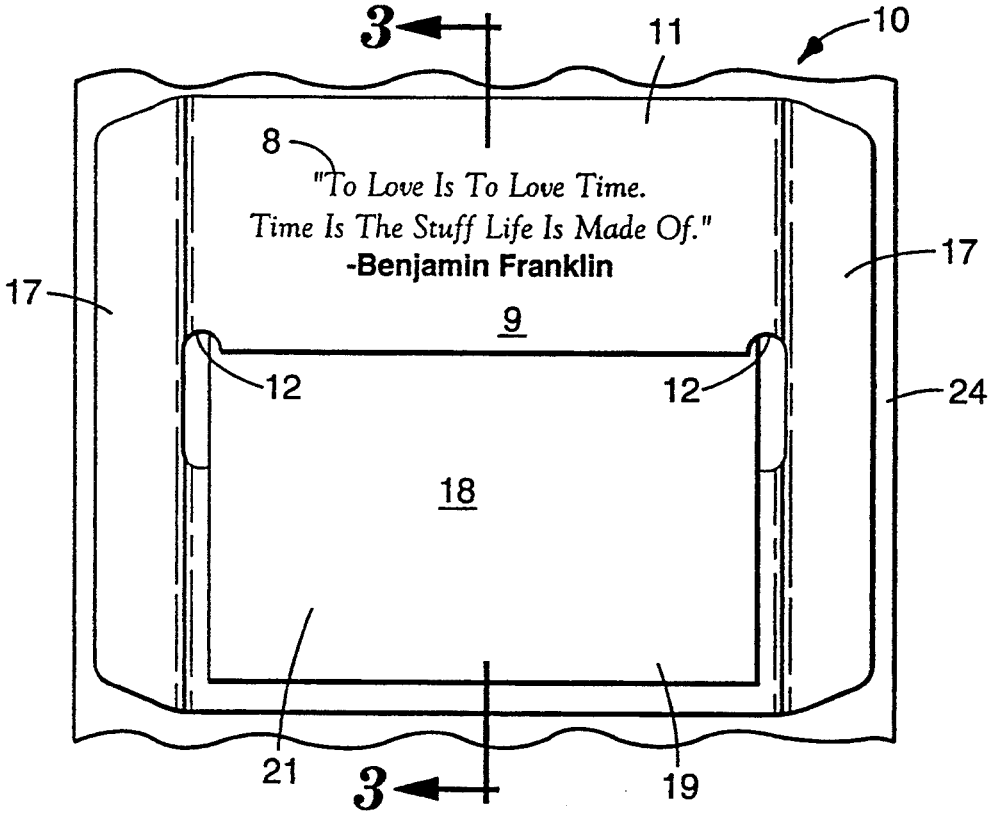
FIG. 1 is a plan view of a first embodiment of a sheet dispenser according to the present invention adhered to a release liner.

Referring now to FIGS. 1 through 4, there is illustrated a first embodiment of a sheet dispenser according to the present invention generally designated by the reference numeral 10.

The sheet dispenser 10 includes a thin, supple, tear-resistant cover layer 11 which can be of a polymeric film that alternatively can be (1) opaque and colored with or without designs and/or indicia printed on its front surface, or, (2) as illustrated, can be transparent. The cover layer 11 has a layer 13 of transparent pressure sensitive adhesive along its inner surface by which the layer 11 of transparent film is laminated to a smaller layer of non-adhesive material 14 (e.g., of paper) that covers a central portion 9 of the cover layer 11 and provides means for causing its inner surface along that central portion 9 to be free of exposed adhesive so that the adhesive layer 13 is only exposed along two rectangular retaining peripheral portions 15 on opposite sides of the central portion 9, and along two rectangular attachable peripheral portions 17 on opposite sides of the central portion 9, which attachable peripheral portions 17 are between and extending at right angles to the retaining peripheral portions 15.

The layer of material 14 is printed with indicia 8 on the surface thereof adhered to the layer 13 of pressure-sensitive adhesive which allows the indicia 7 to be readable through the transparent adhesive and cover layers 13 and 11.

The cover layer 11, adhesive layer 13 and layer of material 14 have a central transverse through slot 12. Positioned against the layer of material 14 along the central portion 9 of the cover layer 11 is a coherent stack 16 of adhesive-bearing dispensable paper sheets 18 (e.g., a stack 16 of the sheets described in U.S. Pat. No. 4,416,392, the content whereof describing the sheets and the way they are disposed in a stack is incorporated herein by reference). The paper notes or sheets 18 in the stack 16 are disposed one on top of another with ends of the sheets 18 being in alignment in the stack 16. On an underside or second surface of each of the adhesive-bearing paper dispensable sheets 18 is a layer or narrow band 20 of pressure-sensitive adhesive adjacent a second end of the sheet, with the bands of successive sheets at opposite sides of the stack 16. Both first and second surfaces of each of the adhesive-bearing dispensable paper sheets 18 are free from adhesive along a major portion adjacent a first end 21 opposite their second ends which provides release means for providing a first adhesion level along first end portions of the sheets adjacent first ends 21 of the backings between the first and second side surfaces of the adjacent sheets 18 in the stack 16, which first adhesion level provides a sufficiently low or no release force between the first side surfaces and the adjacent sheets 18 to which the adhesive along those first side surfaces are releasable adhered to afford sliding movement between the side surfaces of the adjacent sheets 18 along the first end portions. The sheets 18 also include attachment means for providing a second adhesion level along second end portions of the sheets 18 adjacent second ends of the backings between the layers 20 of adhesive and the second side surfaces of the adjacent sheets 18 in the stack 16 to which the layers 20 of adhesive are releasably adhered, which second adhesion level provides a release force that is higher than the sufficiently low or no release force along the first end portions and firmly adhere the sheets 18 to the adjacent sheets 18 in the stack during sliding movement of the sheets 18 relative to the adjacent sheets 18 along the first end portions while affording peeling away of the sheets 18 from the stack 16 along the second end portions of the sheets 18. An end portion 19 of the uppermost of the dispensable sheets extends through the slot 12 and lays flat against the exposed outer surface of the cover layer 11. A backing sheet 22 is positioned adjacent the lowermost dispensable sheet 18 in the stack 16 with the layer-20 of adhesive on the lowermost dispensable sheet 18 adhered to a surface of the backing sheet 22 along a first end 23 thereof. The pair of retaining peripheral portions 15 extend around the adjacent sides of the stack 16 and the edges of the backing sheet 22 and are affixed by the layer of adhesive 13 thereon to the outer surface of the backing sheet 22 along opposite sides of the backing sheet 22. The attachable peripheral portions 17 of the cover layer 11 afford attachment of the dispenser 10 to a substrate.

Prior to use of the sheet dispenser 10, the portion of the layer of adhesive 13 exposed on the attachable peripheral portions 17 can be releasably adhered to a release liner 24 that provides means for temporarily protecting the coating 13 of pressure-sensitive adhesive on the attachable peripheral portions 17.

Alternatively, the outer surface of the backing sheet 22 can be adapted (i.e., if necessary, by coating portions thereof with a release coating) so that the portions of the layer of adhesive 13 exposed on the attachable peripheral portions 17 can be temporarily and removably adhered to the outer surface of the backing sheet 22 to provide means for temporarily protecting the coatings of pressure-sensitive adhesive on the attachable peripheral portions 17.

Figure 2:
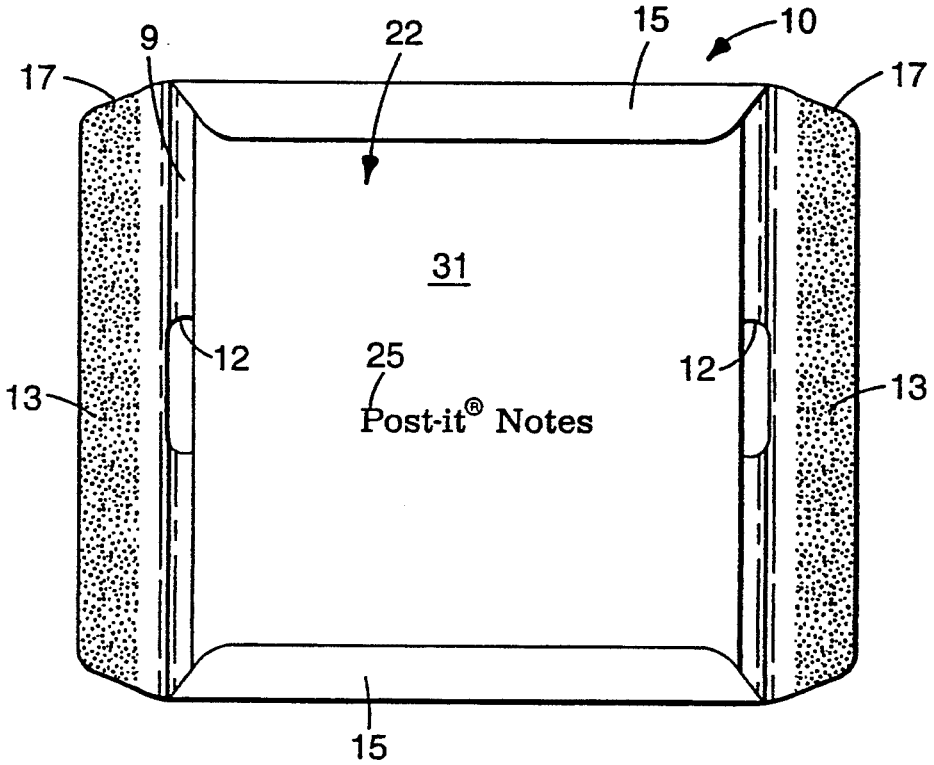
FIG. 2 is a bottom view of the sheet dispenser of FIG. 1 from which the release liner has been removed.

In FIG. 2, the release liner 14 has been peeled from the sheet dispenser 10 to permit it to be adhered on a generally flat surface (not shown) by the coating 13 of pressure-sensitive adhesive on its attachable peripheral portions 17. As seen in FIG. 2, the outer surface of the backing sheet can be printed with indicia 25, which may indicate the maker of the sheet dispenser 10 or provide re-order information.

Figure 3:
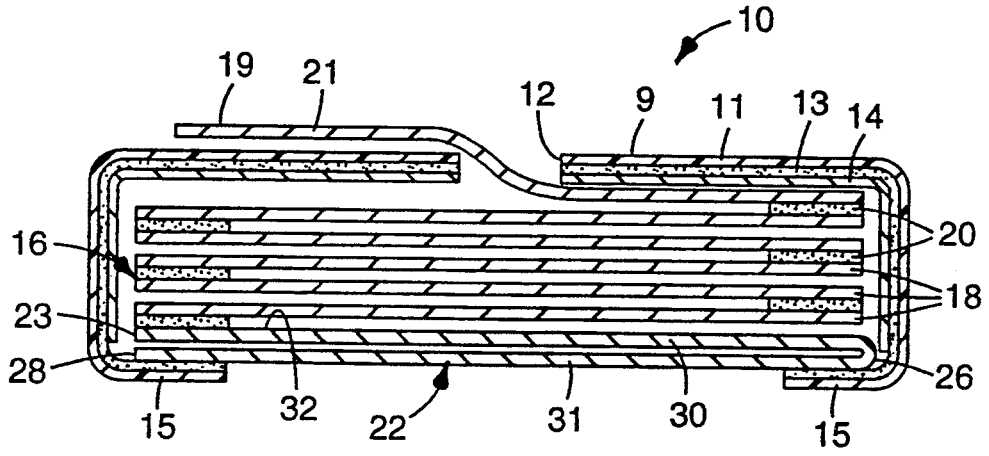
FIG. 3 is a cross sectional view taken generally along line 3—3 of FIG. 1 in which the thickness of the dispenser and various sheets and layers are much exaggerated in order to better illustrate certain aspects of the sheet dispenser.
Figure 4:
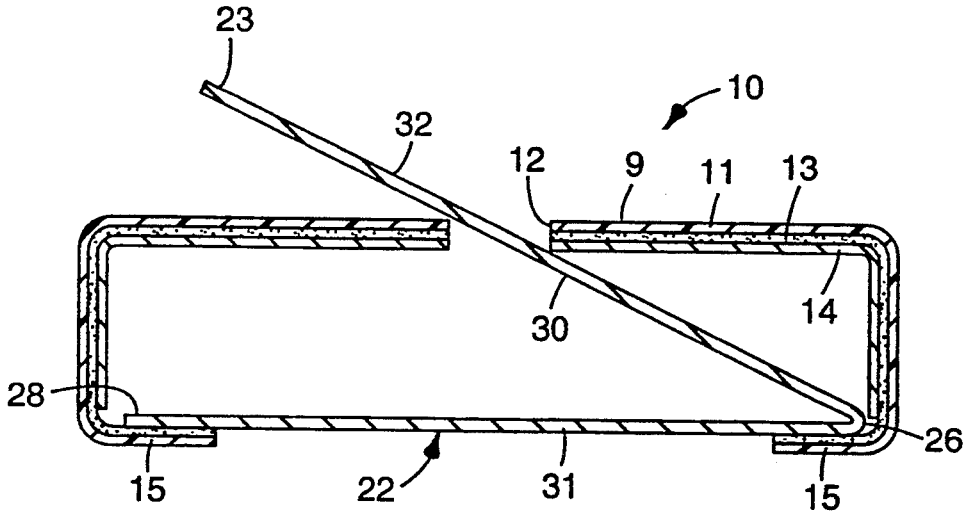
FIG. 4 is a cross sectional view similar to FIG. 3, but in which all of a plurality of dispensable sheets in the dispenser in FIG. 3 have been dispensed leaving a portion of a backing sheet projecting through a slot in the dispenser.

As can be seen in FIG. 3, the backing sheet 22 has one transverse fold 22 parallel to its first end 23 and to an opposite second end 28. The fold 22 defines first and second backing sheet portions 30 and 31 on opposite sides of the fold 32 that are of generally equal size with the first-portion 30 including the first end 23 adjacent which the strip of adhesive on the lowermost dispensable sheet in the stack 16 is adhered. The two retaining peripheral portions 15 are attached to the second portion 31 of the backing sheet 22. The first portion 30 of the backing sheet 22 is adapted to be partially pulled through the slot 12 to the position illustrated in FIG. 4 when the lowermost dispensable sheet is pulled from the dispenser 10. The backing sheet 22 has a surface 32 bearing indicia or graphics adapted to be viewed after the first portion 30 of the backing sheet is partially pulled through the slot 12, which indicia could include advertizing, sage or humorous sayings, re-order information, etc.

Figure 5:
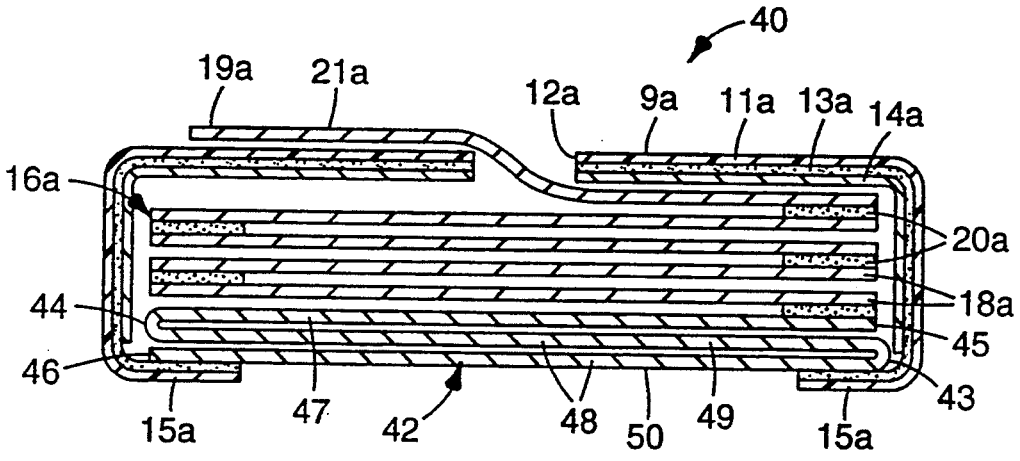
FIG. 5 is a cross sectional view taken generally along line 3—3 of FIG. 1 in which the thickness of the dispenser and various sheets and layers are much exaggerated in order to better illustrate certain aspects of the sheet dispenser, and in which the dispenser of FIG. 1 is illustrated with a first alternate embodiment of a backing sheet used in the dispenser.
Figure 6:
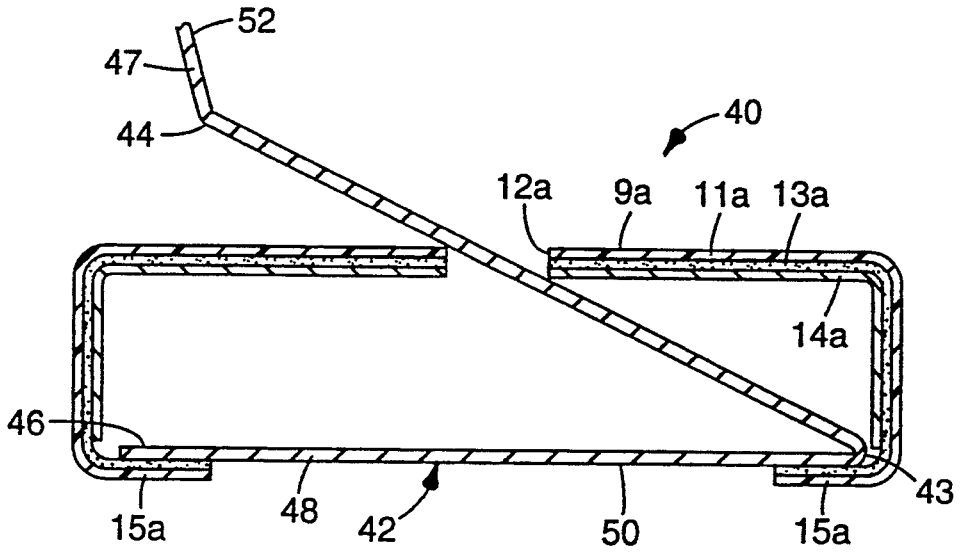
FIG. 6 is a cross sectional view similar to FIG. 5, but in which all of a plurality of dispensable sheets in the dispenser in FIG. 5 have been dispensed leaving a portion of the backing sheet projecting through a slot in the dispenser.

FIGS. 5 and 6 illustrate a dispenser 40 that is essentially the same as the dispenser 10 illustrated in FIGS. 1 through 4 (with similar parts having the same reference numerals to which has been added the suffix "a"), except that the dispenser 40 has a backing sheet 42 that is longer than the backing sheet 22 (see FIGS. 3 and 4), which backing sheet 42 has two (instead of one) transverse folds 43 and 44 parallel to first and second opposite ends 45 and 46 of the backing sheet 42. The first transverse fold 44 defines first and second backing sheet portions 47 and 48 on opposite sides of the first transverse fold 44 with the second backing sheet portion 48 being bigger (i.e., about twice as big) as the first backing sheet portion 47 which includes the first end 45 of the backing sheet 42 adjacent which the strip of adhesive **20*a* on the lowermost dispensable sheet 18*a* in the stack 16*a* is adhered. The second transverse fold 43 in the backing sheet 42 defines first and second parts 49 and 50 of the second backing sheet portion 48 on opposite sides of the second transverse fold 43 with the second part 50 of the second backing sheet portion 48 adjacent the second end 46 of the backing sheet 42. With the backing sheet 42 illustrated in FIGS. 5 and 6, the two retaining peripheral portions 15*a* of the cover layer 11*a* are affixed to the second part 50 of the second portion 48 of the backing sheet 42. The first portion 47 and a portion of the first part 49 of the second portion 48 of the backing sheet 42 will be pulled through the slot 12*a* with the lowermost dispensable sheet 18*a* to the position illustrated in FIG. 6. The backing sheet 42 has a surface 52 bearing indicia adapted to be viewed after the backing sheet 42 is pulled through the slot 12*a***, which indicia could be advertizing, sage or humorous material, reorder information, a manufacturers coupon, etc.

The sheet dispenser according to the present invention could be made with a backing sheet that has more than two folds, thus having a longer length so that a longer length of backing sheet is pulled through the slot with the lowermost dispensable sheet if that is desired to provide a desired message along its length.

Figure 7:
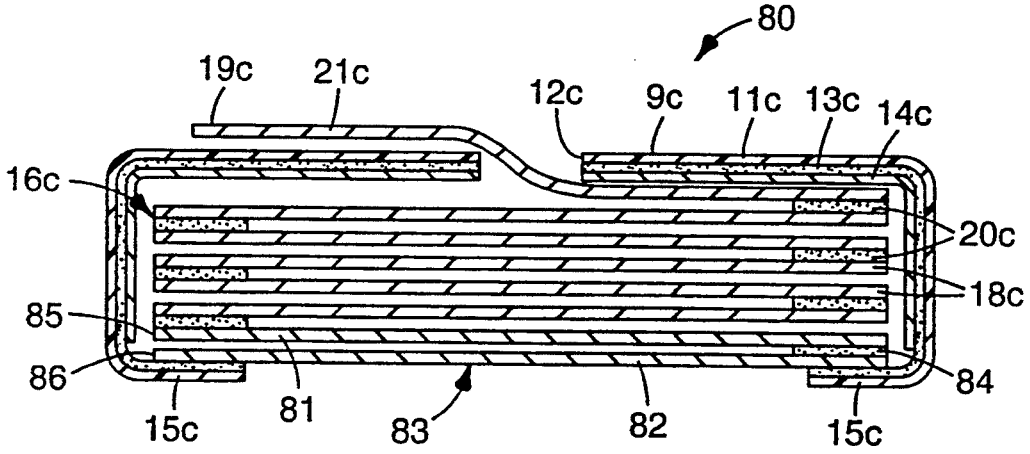
FIG. 7 is a cross sectional view taken generally along line 3—3 of FIG. 1 in which the thickness of the dispenser and various sheets and layers are much exaggerated in order to better illustrate certain aspects of the sheet dispenser, and in which the dispenser of FIG. 1 is illustrated with a second alternate embodiment of a backing sheet used in the dispenser.
Figure 8:
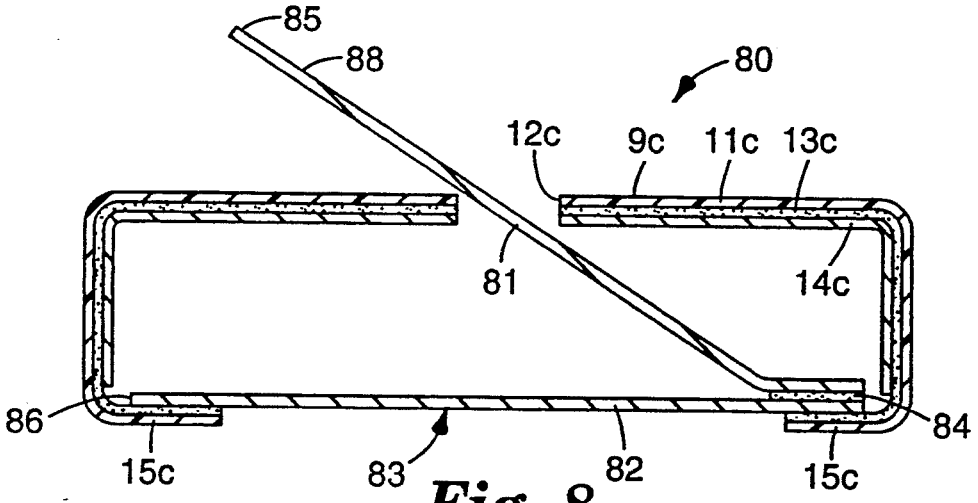
FIG. 8 is a cross sectional view similar to FIG. 7, but in which all-of a plurality of dispensable sheets in the dispenser in FIG. 5 have been dispensed leaving a portion of the backing sheet projecting through a slot in the dispenser.

FIGS. 7 and 8 illustrate a dispenser 80 that is essentially the same as the dispenser 10 illustrated in FIGS. 1 through 4 (with similar parts having the same reference numerals to which has been added the suffix "c"), except that first and second portions 81 and 82 of the backing sheet 83 for the dispenser 80 are separate pieces of paper or polymeric material positioned surface to surface and permanently joined by a strip 84 of permanent adhesive between their surfaces along adjacent edges and extending parallel to first and second opposite ends 85 and 86 of the backing sheet 83. The first backing sheet portion 81 includes the first end 85 of the backing sheet 83 adjacent which the strip of adhesive **20*c* on the lowermost dispensable sheet 18c in the stack 16*c*** is adhered. The two retaining peripheral portions 15*a* of the cover layer 11*a* are affixed to the second portion 82 of the backing sheet 83. A part of the first portion 81 of the backing sheet 83 will be pulled through the slot 12*a* with the lowermost dispensable sheet 18*a* to the position illustrated in FIG. 8. The backing sheet 83 has a surface 88 bearing indicia adapted to be viewed after the backing sheet 42 is pulled through the slot 12*c*.

As a specific example, the cover layer 11 with its coating of pressure sensitive adhesive 13 has been formed from the transparent tape with a polymeric adhesive coated backing that is commercially available from Minnesota Mining and Manufacturing Company (3M), St. Paul, Minn., as Scotch ® #845 tape. The layer of non-adhesive material 14 was made of 20# bond paper that was printed in a laser printer to form the graphics 8, and cut to a square 3,125 inches on each side. The square layer of material 14 was positioned with its printed side against the adhesive layer on the tape and die-cut to form a slot 12 that was 3.375 in. long and 0.5 in. wide, with each corner of each slot being formed by a semicircle with a 0.125 inch radius. Retaining and attachable portions 15 and 17 approximately 0.5 inch wide were formed along the edges of the central portion 9. The backing sheet 22 was also formed of 20 pound bond paper that was custom-printing with indicia in a laser printer. The stack 16 of dispensable paper sheets 18 was square and measured 3 inches along each a side. The liner 24 used was that commercially available from Daubert Coated Papers Company, Westchester, Illinois, as Daubert 4020.

As another specific example, an opaque cover layer 11 with its coating of pressure sensitive adhesive 13 has been formed from the polymeric pressure sensitive adhesive coated label stock commercially available from 3M as Stamark ® #7777. The label stock was printed to form graphics on the outer surface of the cover layer 11 and die-cut to provide the slot 12 that was 3.1 inches long and 0.5 inches wide, and at each corner had a semicircle with a 0.125 inch radius. A liner on the label stock was die-cut to provide a square layer of material 14 measuring 3.375 inches on a side, and the portion of that liner around that layer of material 14 was stripped from the layer 13 of adhesive. The backing sheet 22 was formed of 20 pound bond paper that was custom-printing with indicia in a laser printer. The stack 16 of dispensable paper sheets 18 was 2.75 in. wide and 3.0 in. long, with the layer of adhesive extending along the 2.75 inch wide edge portions.

Figure 9:
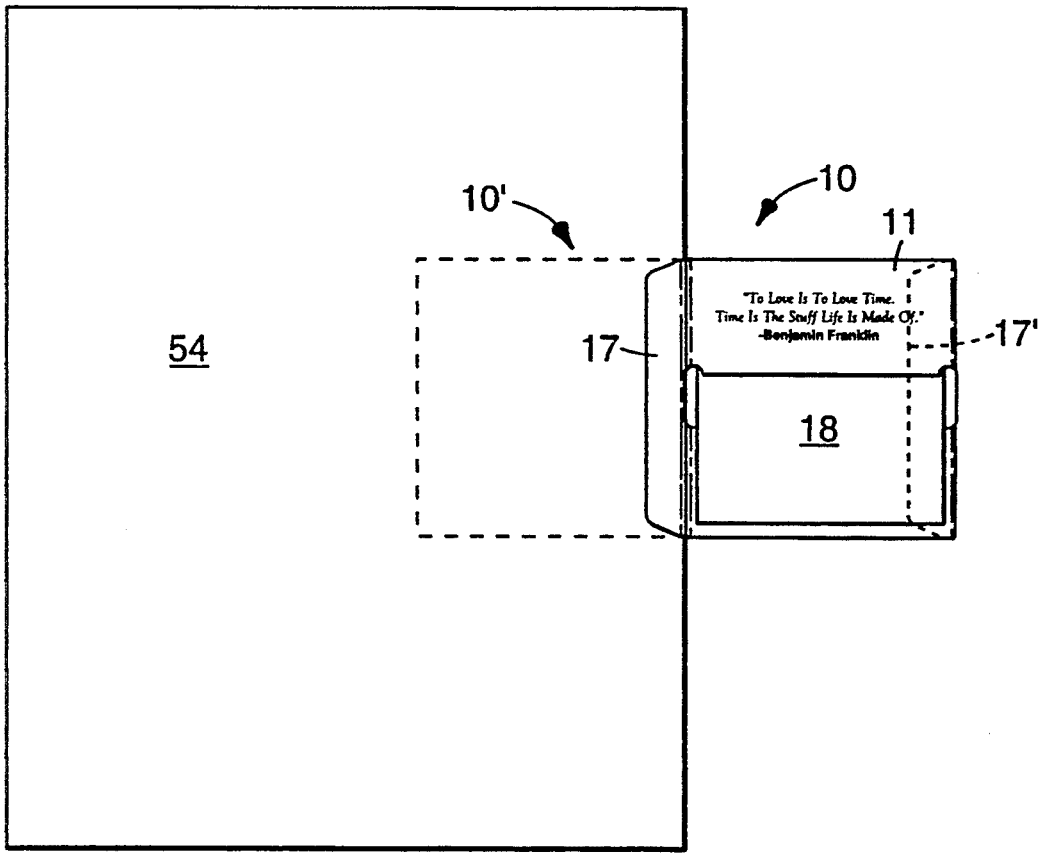
FIG. 9 is a plan view of the dispenser of FIG. 1 adhered along the edge of a sheet.

FIG. 9 illustrates a novel use of the dispenser 10 in which one of the attachable portions 17′ is adhered to the outer surface of the backing layer 22 so that it effectively becomes a retaining portion, and the layer of adhesive on the other attachable portion 17 is adhered along an outer edge of a sheet 54 which may be a page in a book, catalog, or the like so that the dispenser 10 can be pivoted about the connection between that adhered attachable portion 17 between the illustrated position with the dispenser 10 easily accessible along the edge of the sheet 54 (e.g., along the edge of the pages in a book or catalog), to the position illustrated in dotted outline 10′ with the dispenser 10 along the surface of the sheet 54 which could place the dispenser 10 between pages of a book or catalog.

As an alternative to having a coating of pressure sensitive adhesive entirely across the inner surface of the cover layer 11 and using the layer of material 14 to provide means for causing its inner surface along its central portion 9 to be free of exposed adhesive, that means can be provided by pattern coating the cover layer 11 only on the two rectangular retaining peripheral portions 15 and on the two rectangular attachable peripheral portions 17, leaving the central portion 9 free of exposed adhesive. As another alternative, the layer of adhesive 13 on the central portion 9 can be tack free so that the layer of material 14 is not needed, or if the layer of material 14 is used, it could be adhered to the layer of adhesive by the application of heat. The layers of adhesive on the two rectangular retaining peripheral portions 15 and on the two rectangular attachable peripheral portions 17 can then also be tack free and activatable by the application of heat, or may be different, for example, the adhesive on the two rectangular retaining peripheral portions 15 being tack free, and the adhesive on the two rectangular attachable peripheral portions 17 being pressure sensitive. Also, as noted above, the adhesive on the two rectangular attachable peripheral portions 17 can be of aggressive pressure sensitive adhesive, or of repositionable pressure sensitive adhesive depending on the intended use of the dispenser 10.

Figure 10:
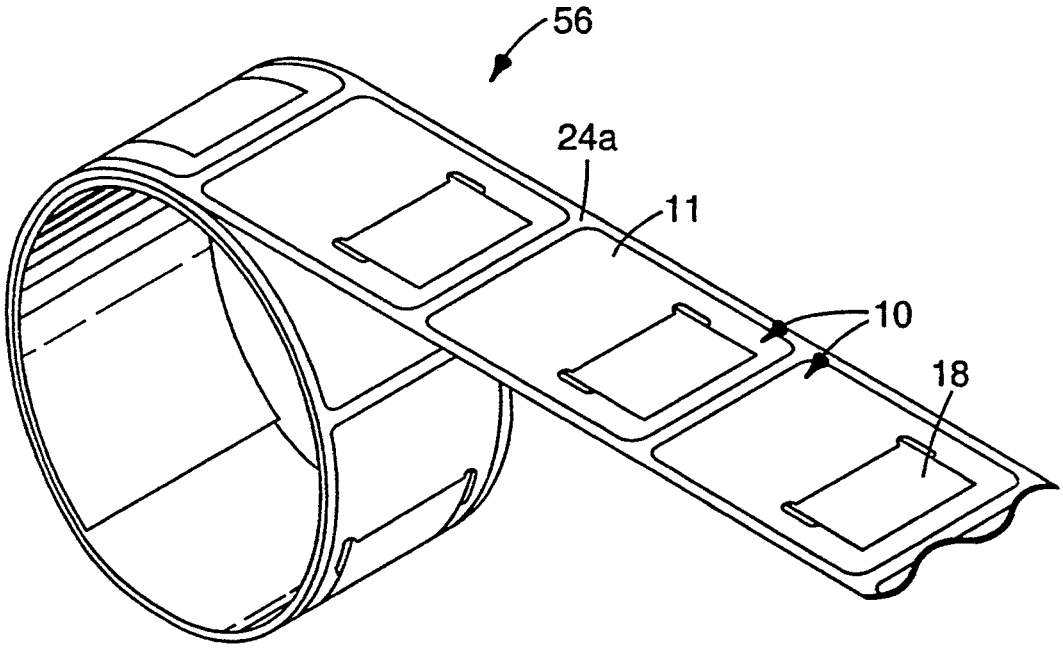
FIG. 10 is a perspective view showing a roll of a plurality of the sheet dispensers of FIG. 1.

FIG. 10 illustrates that the disposable release liner 24 illustrated in FIG. 1 can be a portion of an elongate strip 24*a* on which a plurality of spaced identical sheet dispensers 10 are positioned, which elongate strip 24*a* of disposable release liner and sheet dispensers 10 can be convolutely wound into a roll 56. Such a roll 56 can be used in automated equipment, e.g., known labelling machines by which the dispensers can be individually adhered or self-mounted on sheets of paper to be bound or tipped into books, magazines, catalogs or the like.

Figure 11:
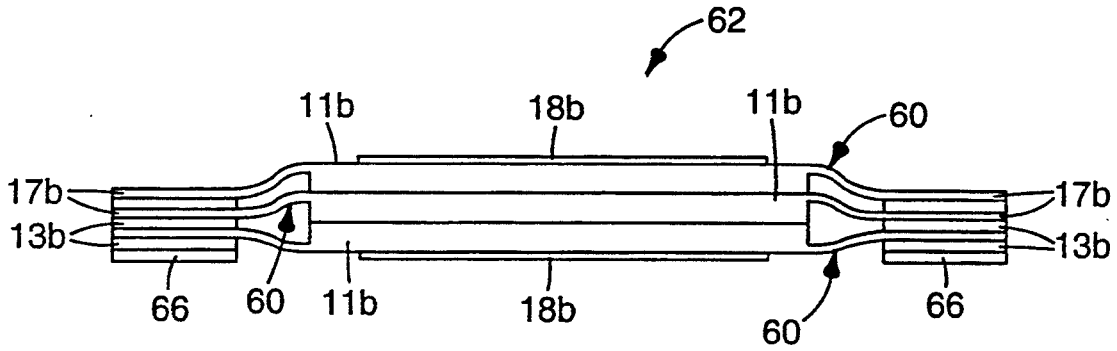
FIG. 11 is an edge view of three stacked sheet dispensers according to the present invention.

FIG. 11 illustrates a plurality of or three sheet dispensers 60 according to the present invention. The three dispensers 60 are adhered together to form a stack 62 of the dispensers 60 from which either the top or bottom dispenser 60 can be peeled to be used individually. The dispensers 60 are essentially the same as the dispenser 10 illustrated in FIGS. 1 through 4, with similar parts having the same reference numerals to which has been added the suffix "b", except that the outer surfaced of the cover layer 11*b* in the dispensers 60 are covered with an ultrathin release coating which is required only along the two rectangular attachable peripheral portions 17*b*, but may be more easily applied to cover the entire outer surface of the cover layer 11*b*. The coating 13*b* of pressure-sensitive adhesive of each of the dispensers 60 temporarily adheres it to the release coating of the underlying dispenser 60 or, in the case of the lowermost sheet dispenser 60, to a strip of disposable release liner 66. Adhering the sheet dispensers together in the stack 62 together with the release liners 66 provides protecting means for temporarily protecting the coatings 13*b* of pressure-sensitive adhesive on the peripheral portions of the cover layers 11*b*.

Because each dispenser 60 has a supple flexible cover layer 11*b*, it can easily be peeled from the adjacent dispenser 60 in the stack 62 and can then be adhered by its coating 13*b* of pressure-sensitive adhesive on a generally flat surface.

Instead of stacking, the protecting means for temporarily protecting the coatings 13*b* of pressure-sensitive adhesive on the two rectangular attachable peripheral portions 17*b* of the cover layers 11*b* on the sheet dispensers 60 can be provided by making a concatenation of cover layers 11*b* from an elongate strip, and wrapping the dispensers 60 on an inner core and on themselves, after which the dispensers 60 can be separated either at perforations between them or by cutting them apart.

The sheet dispensers 10, 40 60, and 80 described above all include stacks of adhesive coated paper sheets that have a narrow band or layer of pressure-sensitive adhesive (i.e., less than 50% of the surface area of each sheet like the repositionable sheets of the above-discussed Smith U.S. Pat. No. 4,416,392). The dispenser according to the present invention can easily be modified so that it includes a stack of paper or polymeric sheets (e.g., tape flags) that each have a wide band or layer of pressure-sensitive adhesive covering at least 50% of the area of one surface of each sheet, or a wide band that covers one entire surface of each sheet (like the repositionable sheets described in the above-cited Miles et al U.S. Pat. No. 4,907,825 and Blackwell U.S. Pat. No. 5,086,946). Such modification could include not adhering the bottom dispensable sheet in the stack to the backing sheet, and making the central portion of the cover layer sufficiently wide in the direction normal to the length of the slot so that the stack of sheets can shuttle back in forth between the backing sheet and the cover layer as sheets are dispensed.

Also, the stacks in the dispensers 10, 40, 60 and 80 may be made from sheets disposed in stacks in the manner taught in the Smith U.S. Pat. No. 4,416,392 where the sheets have both tab and body portions as is taught in U.S. patent application Ser. No. 08/084,798 filed Jun. 29, 1993, the content whereof is incorporated herein by reference.

The present invention has now been described with reference to several embodiments thereof. It will be apparent to those skilled in the art that many changes can be made in the embodiments described without departing from the scope of the present invention. Thus the scope of the present invention should not be limited to the structures methods described in this application, but only by structures and methods described by the language of the claims and the equivalents of those structures and methods.

What is claimed is:

1. A sheet dispenser adapted for use on a surface such as that of a page in a book, magazine, personal organizer or the like, said sheet dispenser comprising:

(a) a stack of dispensable sheets disposed one on top of another and including an uppermost sheet and a lowermost sheet, each sheet in said stack comprising a backing having opposite first and second major side surfaces and opposite first and second ends with ends of the sheets being in alignment in the stack, and a layer of adhesive permanently adhered to the first side surface of said backing, the layers of adhesive of said sheets being releasably adhered along the second surfaces of the adjacent sheets in said stack, at least some of said sheets comprising release means for providing a first adhesion level along first end portions of said sheets adjacent said first ends of said backings between said first side surfaces and the second side surfaces of the adjacent sheets in the stack to which the layers of adhesive are releasably adhered, which first adhesion level provides a sufficiently low or no release force between said first side surfaces and the adjacent sheets to which the adhesive along those first side surfaces are releasable adhered to afford sliding movement between the side surfaces of the adjacent sheets along said first end portions, and attachment means for providing a second adhesion level along second end portions of said sheets adjacent said second ends of said backings between said layers of adhesive and the second side surfaces of the adjacent sheets in the stack to which said layers of adhesive are releasably adhered, which second adhesion level provides a release force that is higher than said sufficiently low or no release force along said first end portions and firmly adhere the sheets to the adjacent sheets in the stack during sliding movement of the sheets relative to the adjacent sheets along said first end portions while affording peeling away of the sheets from the stack along said second end portions;

(b) a cover layer having inner and outer major surfaces, a central portion having sides, two retaining peripheral portions along opposite sides of said central portion, at least one attachable peripheral portion along one of said sides of said central portion between said two retaining peripheral portions, and a through slot extending transversely across said central portion;

(c) coatings of pressure-sensitive adhesive on said inner surface along said attachable peripheral portion of the cover layer;

(d) means for causing said inner surface along said central portion to be free of exposed adhesive; and (e) said stack of sheets being positioned along the inner surface adjacent said central portion with the first end portion of the uppermost dispensable sheet in the stack extending through said slot;

(f) a backing sheet having opposite first and second ends, said backing sheet being positioned adjacent the lowermost sheet on said stack with the layer of adhesive on the lowermost dispensable sheet adhered to the backing sheet along said first end;

(g) said pair of retaining peripheral portions extending around the sides of said stack adjacent said retaining portions and being affixed along opposite sides of said backing sheet;

(h) said dispensable sheets and slot being adapted to afford dispensing of the dispensable sheet having the first end portion extending through the slot when that first end portion is manually pulled through the slot by sequential sliding movement of one of the dispensable sheets relative to the adjacent dispensable sheet along the first end portion and peeling away of the dispensable sheet from the stack along said second end portion, and positioning of the first end portion of an underlying dispensable sheet in a position extending through the slot as a result of said dispensing; and (i) said attachable peripheral portion of the cover layer affording attachment of said dispenser to a substrate.

2. A sheet dispenser according to claim 1 wherein said backing sheet has at least one transverse fold parallel to said ends that defines first and second backing sheet portions on opposite sides of said fold with said first portion including said first end, said two retaining peripheral portions are attached to said second portion of said backing sheet, said first portion of said backing sheet is adapted to be pulled through said through slot with said lowermost dispensable sheet during dispensing of said lowermost dispensable sheet of said stack, and said backing sheet has a surface bearing indicia adapted to be viewed after said first portion of said backing sheet is pulled through said through slot during dispensing of said lowermost dispensable sheet of said stack.

3. A sheet dispenser according to claim 2 wherein said second backing sheet portion has a second transverse fold defining first and second parts of said second backing sheet portion on opposite sides of said second transverse fold with said second part of said second backing sheet portion adjacent said second end of said backing sheet, and said two retaining peripheral portions are affixed to said second part of said second portion of said backing sheet.

4. A sheet dispenser according to claim 1 wherein said backing sheet has first and second backing sheet portions that are separate pieces of material positioned surface to surface and permanently joined by a strip of permanent adhesive between their surfaces along adjacent edges and extending parallel to first and second opposite ends of the backing sheet, said first backing sheet portion including the first end of the backing sheet adjacent which the strip of adhesive on the lowermost dispensable sheet in the stack is adhered, the two retaining peripheral portions of the cover layer are affixed to the second portion of the backing sheet, a part of the first portion of the backing sheet will be pulled through the slot with the lowermost dispensable sheet, and said backing sheet has a surface bearing indicia adapted to be viewed after the backing sheet is pulled through the slot.

5. A sheet dispenser according to claim 1 wherein said coating of pressure-sensitive adhesive covers the entire cover layer and a non-adhesive layer is adhered to the pressure-sensitive adhesive layer along said central portion to provide said means for causing said inner surface along said central portion to be free of exposed adhesive, leaving the pressure-sensitive adhesive layer exposed along said attachable peripheral portion.

6. A sheet dispenser according to claim 5 wherein said cover layer and said pressure-sensitive adhesive layer are transparent, and said layer of non-adhesive material has printed indicia on the surface thereof adhered to the pressure-sensitive adhesive layer that is readable through said cover layer.

7. A sheet dispenser according to claim 1 further including protecting means for temporarily protecting said coatings of pressure-sensitive adhesive on said attachable peripheral portion.

8. A sheet dispenser according to claim 7 wherein said protecting means is an elongate release liner on which a plurality of identical sheet dispensers are positioned, said elongate release liner and sheet dispensers being helically wound into a roll.

9. A sheet dispenser according to claim 7, wherein said sheet dispenser is one of a plurality of identical sheet dispensers disposed adhered together with the layer of pressure-sensitive adhesive on said inner surface along said attachable peripheral portion of the cover layer on the majority of the sheet dispensers being releasably adhered to the outer surface of the cover layer on an underlying adjacent sheet dispenser.

10. A plurality of sheet dispensers according to claim 9 wherein the outer surface of said cover layers are covered with a release coating, and said sheet dispensers are aligned in a stack.

11. A sheet dispenser according to claim 1 wherein said cover layer is transparent, and said dispenser includes a printed layer of material attached along the inner surface of said cover layer that is readable through said cover layer.

12. A sheet dispenser according to claim 1 wherein said layer of pressure-sensitive adhesive on said dispensable sheet covers less than 50% of the first side surface of the dispensable sheet.

13. A sheet dispenser according to claim 1 wherein said cover layer consists of biaxially oriented polypropylene.

14. A sheet dispenser according to claim 1 wherein said layer of pressure-sensitive adhesive on said cover layer is repositionable pressure-sensitive adhesive.

15. A sheet dispenser according to claim 1 wherein said cover layer is supple and less than 0.2 millimeter (0.008 inch) in thickness, and said sheet dispenser is less than 3.5 millimeters in thickness.

16. A sheet dispenser according to claim 1 wherein said cover layer includes two attachable peripheral portions along opposite sides of said central portion between said two retaining peripheral portions.

17. A sheet dispenser according to claim 16 wherein said coatings of pressure-sensitive adhesive on said attachable peripheral portions are temporarily and removably adhered to said backing sheet to provide means for temporarily protecting said coatings of pressure-sensitive adhesive on said attachable peripheral portions.

* * * * *